US006685415B2

(12) United States Patent
Rush et al.

(10) Patent No.: US 6,685,415 B2
(45) Date of Patent: Feb. 3, 2004

(54) BOOKBINDING METHOD

(75) Inventors: Christopher J. Rush, San Leandro, CA (US); Laura H. Rush, San Leandro, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 09/944,544

(22) Filed: Aug. 31, 2001

(65) Prior Publication Data

US 2002/0031630 A1 Mar. 14, 2002

Related U.S. Application Data

(62) Division of application No. 09/216,281, filed on Dec. 18, 1998.

(51) Int. Cl.[7] ..... B42C 9/00; B42D 1/00; B42D 3/00

(52) U.S. Cl. ..... 412/37; 281/21.1; 281/29; 281/36; 283/81; 283/101; 412/1; 412/4; 412/5; 412/8; 412/19; 412/20; 412/21; 412/902; 428/40.1; 428/41.8; 428/41.9; 428/42.1; 400/279

(58) Field of Search ..... 281/29, 21.1, 36; 412/37, 4, 5, 8, 19, 20, 21, 1, 902; 283/81, 101; 428/40.1, 41.8, 41.9, 42.1; 400/279

(56) References Cited

U.S. PATENT DOCUMENTS

| | | | | | |
|---|---|---|---|---|---|
| 3,531,358 | A | * | 9/1970 | Rost et al. | 156/475 |
| 3,847,718 | A | | 11/1974 | Watson | 161/39 |
| 4,244,069 | A | * | 1/1981 | Hale | 412/33 |
| 4,420,282 | A | | 12/1983 | Axelrod | 412/4 |
| 4,496,617 | A | | 1/1985 | Parker | 428/55 |
| 4,614,949 | A | * | 9/1986 | Hakkaku et al. | 347/216 |
| 4,767,654 | A | * | 8/1988 | Riggsbee | 428/41.3 |
| 5,078,563 | A | * | 1/1992 | Lolli | 412/8 |
| 5,120,176 | A | * | 6/1992 | Bhatia et al. | 412/8 |
| 5,340,155 | A | * | 8/1994 | Podosek | 281/29 |
| 5,403,138 | A | * | 4/1995 | Otake et al. | 412/1 |
| 5,452,920 | A | * | 9/1995 | Parker | 281/21.1 |
| 5,833,423 | A | * | 11/1998 | Yamaguchi et al. | 412/8 |
| 6,065,884 | A | * | 5/2000 | Parker et al. | 400/611 |
| 6,155,763 | A | * | 12/2000 | Parker et al. | 412/6 |
| 6,322,867 | B1 | * | 11/2001 | Rush et al. | 428/40.1 |
| 6,428,260 | B1 | * | 8/2002 | Parker | 412/6 |
| 2002/0007901 | A1 | * | 1/2002 | Parker et al. | 156/196 |

* cited by examiner

*Primary Examiner*—A. L. Wellington
*Assistant Examiner*—Mark T. Henderson
(74) *Attorney, Agent, or Firm*—Girard & Equitz LLP

(57) ABSTRACT

A bookbinding structure and method. The bookbinding structure is used to bind pages together in existing, commercially available binding machines. The bookbinding structure has a heat activated adhesive matrix for binding the pages. To attach a wrap-around book cover once the pages have been bound with the bookbinding structure, an adhesive on the outer surface of the bookbinding structure may be exposed by removing a release liner covering the adhesive. The book cover may then be adhered to the exposed adhesive either by a heat method or by applying pressure over the adhesive, depending on the particular type of adhesive of the bookbinding structure. The book cover may be printed with information and/or graphics prior to being wrapped around the pages of the book.

7 Claims, 13 Drawing Sheets

BOOKBINDING METHOD

This application is a Divisional of Ser. No. 09/216,281 filed on Dec. 18, 1998.

BACKGROUND OF THE INVENTION

1. Field of the Invention

The present invention relates generally to the field of bookbinding, and more particularly, to a bookbinding structure and method that may be used with a wrap-around book cover.

2. Description of Related Art

Bookbinding systems utilizing binder strips are well known. Binder strips are used to bind pages together to form a book in which the binder strip forms the spine of the book. Binder strips which use a heat activated adhesives of low and high viscosity are used to bind a stack of sheets using heat and pressure which are applied to the strip and stack using a special purpose binding machine.

U.S. Pat. No. 4,496,617, the contents of which are hereby fully incorporated herein by reference, describes such a binding strip. The strips include an elongated paper substrate and an adhesive matrix disposed on the substrate. The matrix includes a central adhesive band which is heat activated and which has a relatively low viscosity when activated and a pair of outer adhesive bands. The outer bands are also heat activated, but are of a relatively high viscosity. The central adhesive band functions to secure the edges of the pages to be bound together and to the substrate and the outer bands function to secure the front and back cover pages to the substrate.

Such prior art binder strips are, however, not suitable for some applications due to the appearance of books bound by such strips. The spines of books bound by the conventional binder strips are often devoid of any printed information because the binder strips require specialized equipment for printing on the strip. Moreover, it is sometimes desirable to have a uniform cover having a continuous design from the front cover to the back cover, frequently including the spine. A conventional binder strip cannot provide a bound book having a cover with such a continuous design.

Another prior art bookbinding system, such as disclosed in U.S. Pat. No. 4,289,330, utilizes a continuous cover structure that forms the front and rear covers of the bound book together with the spine. A heat activated adhesive is deposited on the inside of the cover structure to secure the individual pages together. A significant disadvantage of such continuous cover structures is that many printing processes utilize heat sensitive inks which would be adversely affected by the heat applied to the cover structure during binding. Thus, it would not be possible to print on the cover structure using such popular printing processes. Furthermore, the presence of the adhesive on the cover structure can be bulky thereby making printing difficult using some types of printers. In addition, somewhat specialized equipment is needed to carry out the binding process.

The present invention overcomes the shortcomings of the above-described prior art. It is possible to carry out the binding process using the same machine used to bind books using conventional binder strips of the type disclosed in U.S. Pat. No. 4,496,617. Some of the embodiments of the invention permit the front and rear covers and the spine of the final bound book to be printed prior to binding using a wide variety of printing techniques including techniques employing heat sensitive inks. These and other advantages of the present invention will become apparent to those skilled in the art upon a reading of the following Detailed Description of the Invention.

SUMMARY OF THE INVENTION

A bookbinding structure and method are disclosed. The structure includes an elongated substrate having a length that is equal to the length of the stack of pages to be bound. An adhesive matrix is included which is supported by the substrate and which includes a pair of outer adhesive bands extending along a longitudinal axis of the substrate and a central adhesive band intermediate the outer adhesive bands. The outer adhesive bands have a viscosity when activated which is greater than the viscosity of the central band.

The bookbinding structure further includes an adhesive layer supported by the substrate and having a first surface facing a first surface of the adhesive matrix. Means for exposing the second surface of the adhesive layer, opposite the first surface, is included which permits a cover assembly to become attached to the bookbinding structure by way of the adhesive layer after the pages have been bound.

In one embodiment, the adhesive layer is a pressure activated layer disposed on the substrate surface opposite the substrate surface on which the adhesive matrix is mounted. The means for exposing includes a release liner disposed over the pressure activated adhesive. The release line is removed after the stack has been bound by the adhesive matrix thereby exposing the pressure activated adhesive so that the pressure activated adhesive can be used to attach a cover assembly to the stack.

In a further embodiment, the adhesive layer is a solvent activated layer disposed on one surface of the substrate opposite a substrate surface on which the adhesive matrix is mounted. After the stack has been bound with the adhesive matrix, a solvent is applied to the adhesive layer so the solvent activated adhesive can be used to attach the cover assembly to the stack.

In a still further embodiment, the adhesive layer is a heat activated layer disposed intermediate the adhesive matrix and the substrate. After the stack has been bound with the adhesive matrix, the cover assembly is positioned over the adhesive layer and heat is reapplied to the adhesive layer through the cover assembly thereby activating the adhesive layer so that the cover assembly will be secured to the bound stack.

BRIEF DESCRIPTION OF THE DRAWINGS

The invention will be better understood by reference to the attached figures in which.

DETAILED DESCRIPTION OF THE INVENTION

Figure 1A:
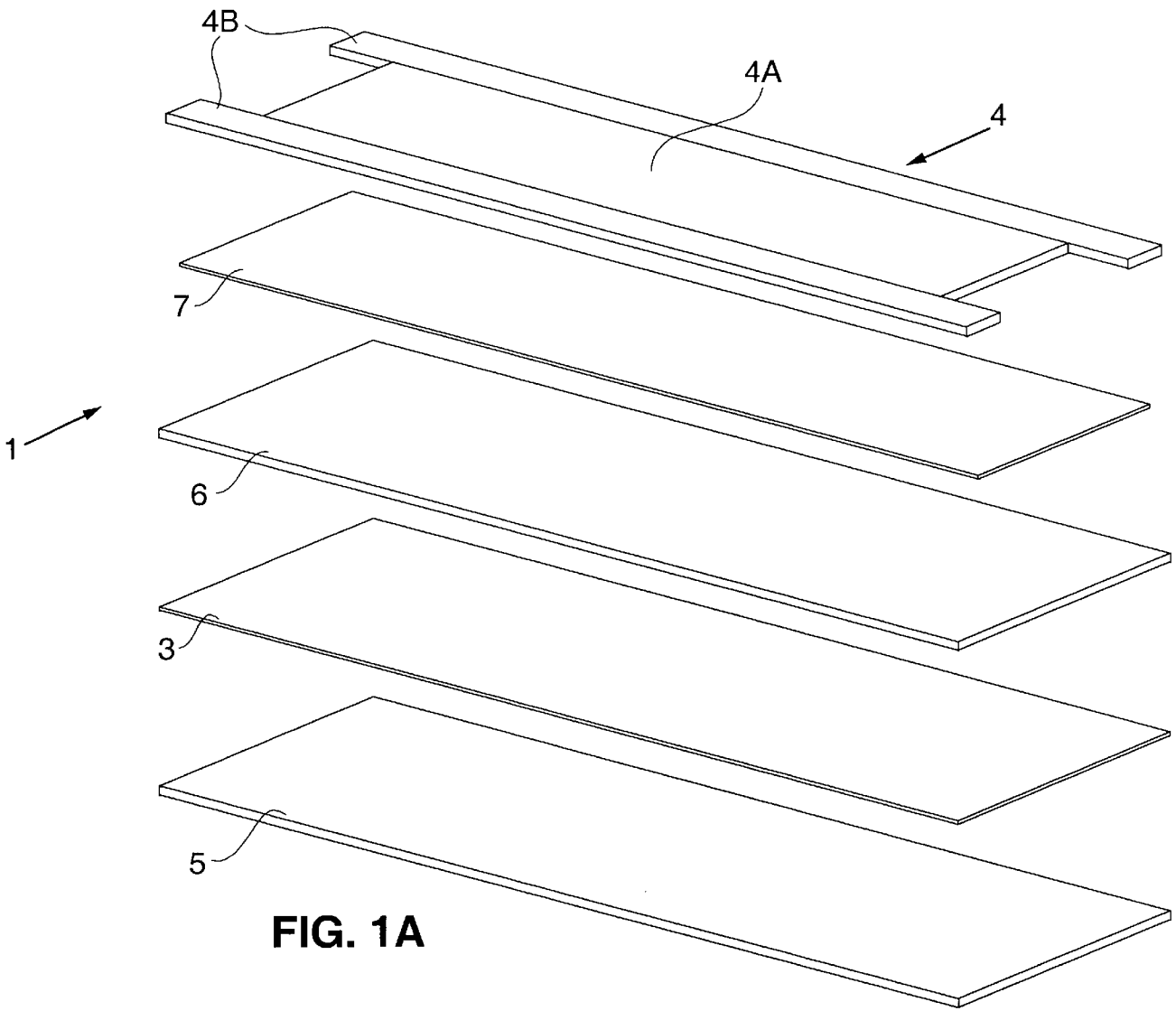
FIG. 1A is an exploded view of the various layers of a first embodiment of the subject bookbinding structure.

The present invention is a bookbinding structure and method. The various embodiments of the invention will be described with reference to FIGS. 1A through 9C. Referring to the drawings, FIG. 1A is an exploded perspective view of the various layers a first embodiment of the bookbinding structure 1. In the first embodiment, the bookbinding structure 1 includes an elongated substrate 6 having a length which corresponds to the length of the stack of pages (not depicted) to be bound and a width which exceeds the thickness of the stack by at least a minimum amount so that the edges of the substrate 6 will extend around the edge of the stack and slightly over the front and back pages of the stack, as will be described. Substrate 6 is preferably made of a formable material such as heavy weight paper.

A layer of pressure activated adhesive 3 is disposed on one surface of the substrate 6, with a heat activated adhesive matrix 4 being disposed facing the opposite substrate surface. The pressure activated adhesive 3 is typically a permanently binding adhesive which, once activated by applying pressure, produces a relatively permanent bond. One such pressure activated adhesive is sold under the designation HL-2593 by H.B. Fuller Company of St. Paul, Minn. The Fuller HL-2593 pressure activated adhesive can be subjected briefly to high temperatures, up to about 425° F., without decomposing. The ability of the pressure activated adhesive 3 to withstand high temperatures is important because the bookbinding structure 1 is subjected briefly to high temperatures during the binding process, which will be described in more detail below. The pressure activated adhesive is preferably 0.003 to 0.005 inches thick.

The pressure activated adhesive 3 is covered with a removable release liner 5, as shown in FIG. 1A, to act as a barrier between the pressure activated adhesive 3 and the environment. The release liner 5 is preferably a silicon coated paper, such as made by Akrosil, Inc. of Menasha, Wis. under the designation Silox™ SBL60SC F1U/F4B. The surfaces of the coated paper can have varying release levels, with a low or easy release level indicating that the paper can be separated with little force and a high or tight release level indicating the separation requires a relatively large amount of force. The designation F4B indicates that the release level of the liner surface contacting the pressure sensitive adhesive layer 3 has a medium release level, with the opposite surface of the liner having a low or easy release level as indicated by the designation F1U.

The heat activated adhesive matrix 4 is comprised of a center adhesive 4A which extends along the longitudinal axis of the substrate 6 and a pair of outer adhesive bands 4B. The center adhesive band 4A, which is a heat activated adhesive of relatively low viscosity, is the primary adhesive for binding the pages together. The center adhesive 4A is typically 0.015 inch thick. An adhesive, sold under the designation Cool Bind 34-1301 by National Starch & Chemical Company of Bridgewater, N.J., has been found to be suitable as the center adhesive band 4A. The center adhesive band 4A preferably extends over slightly less than the full length of the bookbinding structure 1 so that there are end gaps without the center adhesive 4A. In addition, the center adhesive band is at least as wide as the thickness of the stack 13 to be bound so that all of the pages of the stack will be exposed to the low viscosity adhesive.

The outer adhesive bands 4B are comprised of a heat activated adhesive of relatively high viscosity when activated and possesses a high degree of tackiness. The outer adhesive bands 4B function to attach the substrate 6 to the front and back pages of the stack. The outer adhesive bands 4B preferably extend along the entire length of substrate 6 and are 0.010 inch thick. An adhesive sold under the designation HB HL-1777 by H.B. Fuller Company of St. Paul, Minn., may be used for the outer adhesive bands 4B.

The FIG. 1A bookbinding structure further includes an undercoat adhesive layer 7 disposed intermediate the adhesive matrix 4 and the substrate 6. The undercoat adhesive is heat activated and is relatively thin, typically 0.003 inches thick. The undercoat is preferably the same type of adhesive used in the outer adhesive bands 14B and functions to act as a barrier so as to prevent the low viscosity central adhesive band 4A from passing through the substrate 6. In addition, the undercoat adhesive prevents all of the low viscosity adhesive of central band 4A from being drawn up between the pages of the stack which may leave essentially no adhesive intermediate the edges of the pages and the substrate 6.

Figure 4:
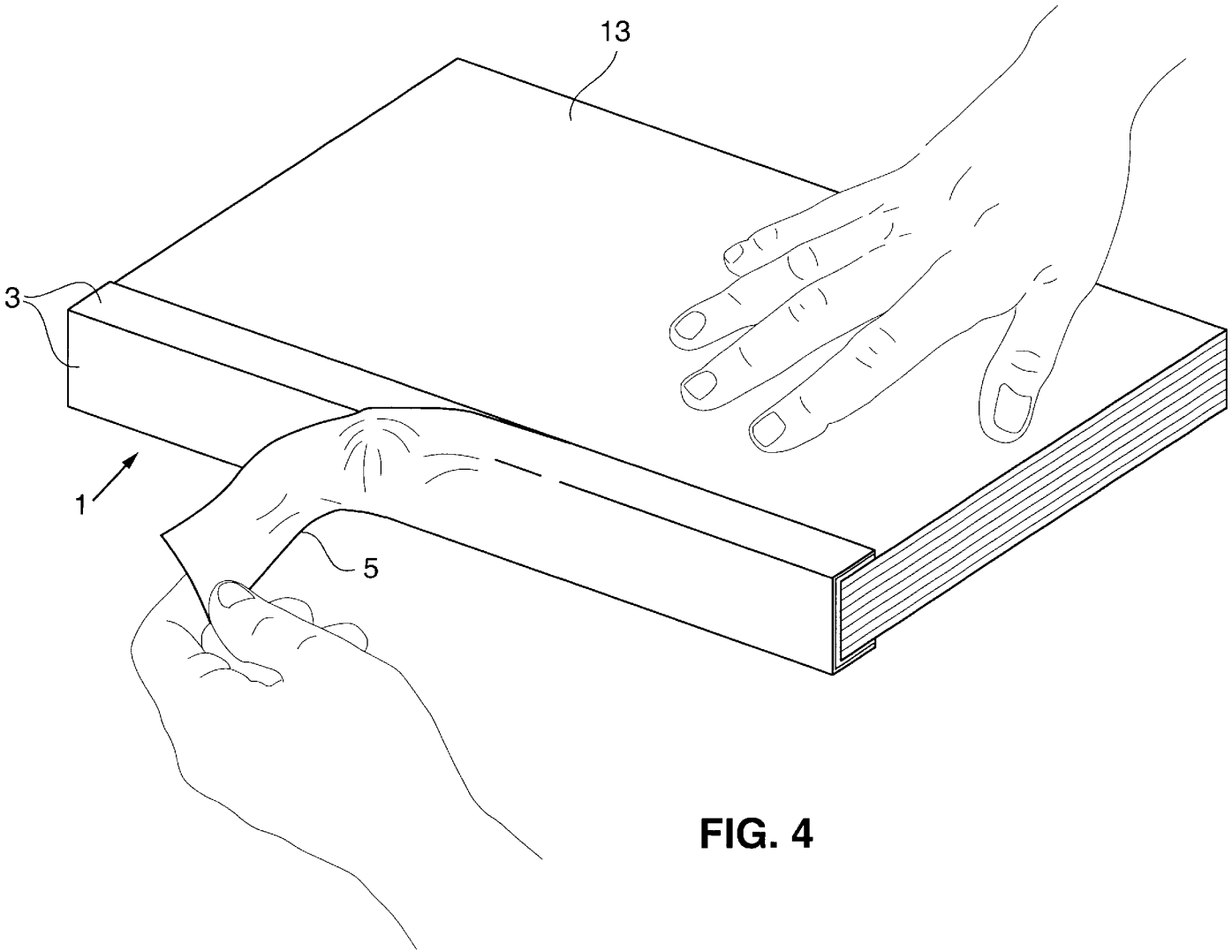
FIG. 4 shows the release liner being peeled away from the pressure activated adhesive of the first embodiment of the bookbinding structure after the book has been bound.
Figure 5:
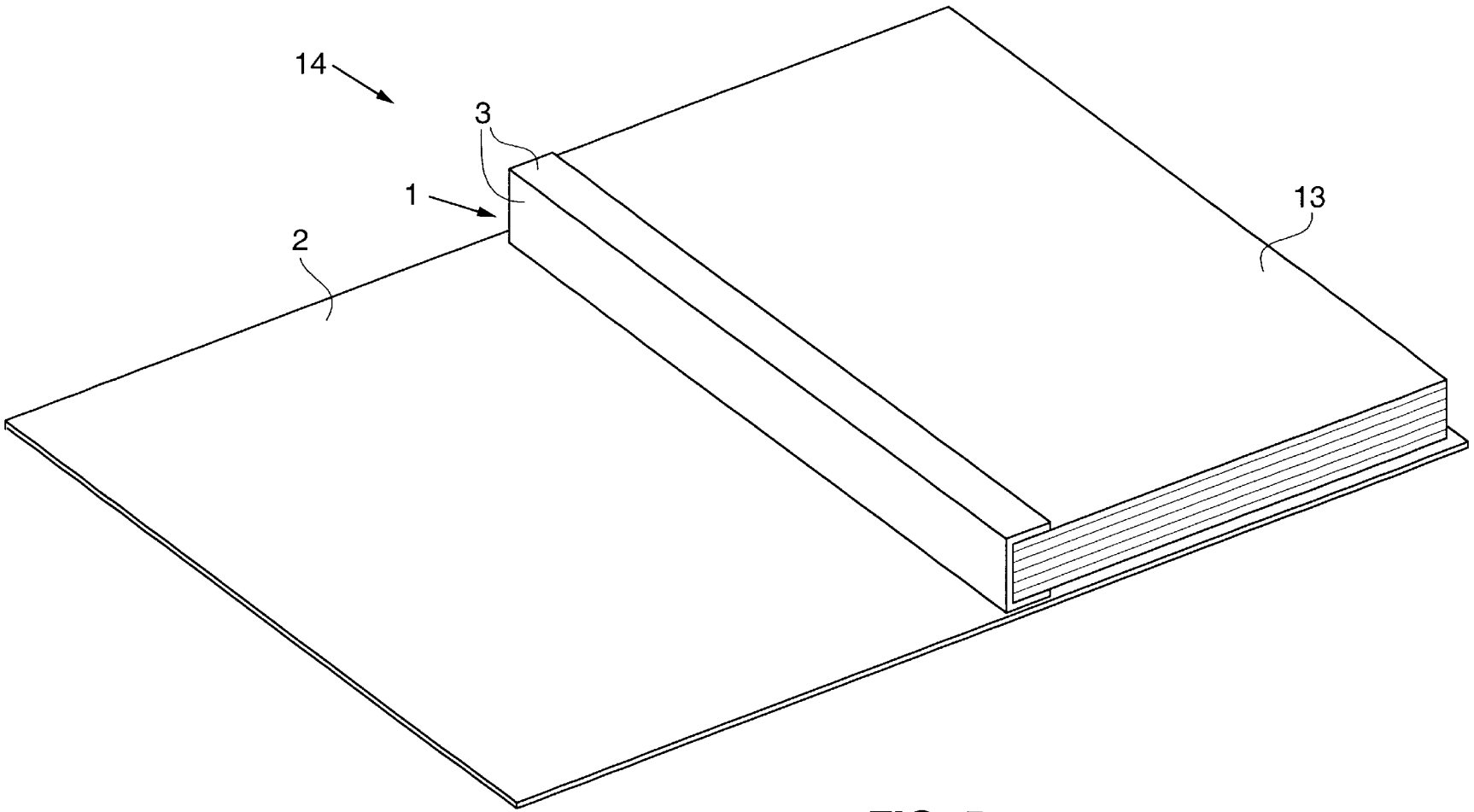
FIG. 5 is a perspective view of the bound book positioned on a wrap-around book cover prior to folding of the cover.

The manner in which the FIG. 1A bookbinding structure 1 is applied to the stack 13 and used to bind the stack will be subsequently described. However, once the stack of pages has been bound, the structure 1 and stack 13 appear as shown in FIG. 4. As can be seen, the structure 1 is positioned on the bound edge of stack 13. Note that the bound stack 13 does not include a cover at this stage of the sequence, with top of the stack being the first page and the bottom of the stack being the last page. The pressure sensitive adhesive 3 is exposed by manually removing the release liner 5 as shown in the drawing. A cover assembly or book cover 2 is positioned on a flat surface as shown in FIG. 5. The bound book 13 is then carefully positioned above the cover 2 so that the stack is aligned with the right hand portion of the cover, with the bound edge of the stack being positioned near the center of the cover. After alignment, the stack 13 is lowered on to the book cover 2 so that the bottom portion of the exposed adhesive contacts the cover. Once this occurs, it is not practical to attempt to realign the stack 13 relative to the cover 2 since the adhesive bond is permanent. Accordingly, it is important that the alignment be correct in the first instance. It has been found that an "L" shaped ruler, referred to as a carpenter's square, can be placed on the work surface and used to carry out the alignment.

Figure 6:
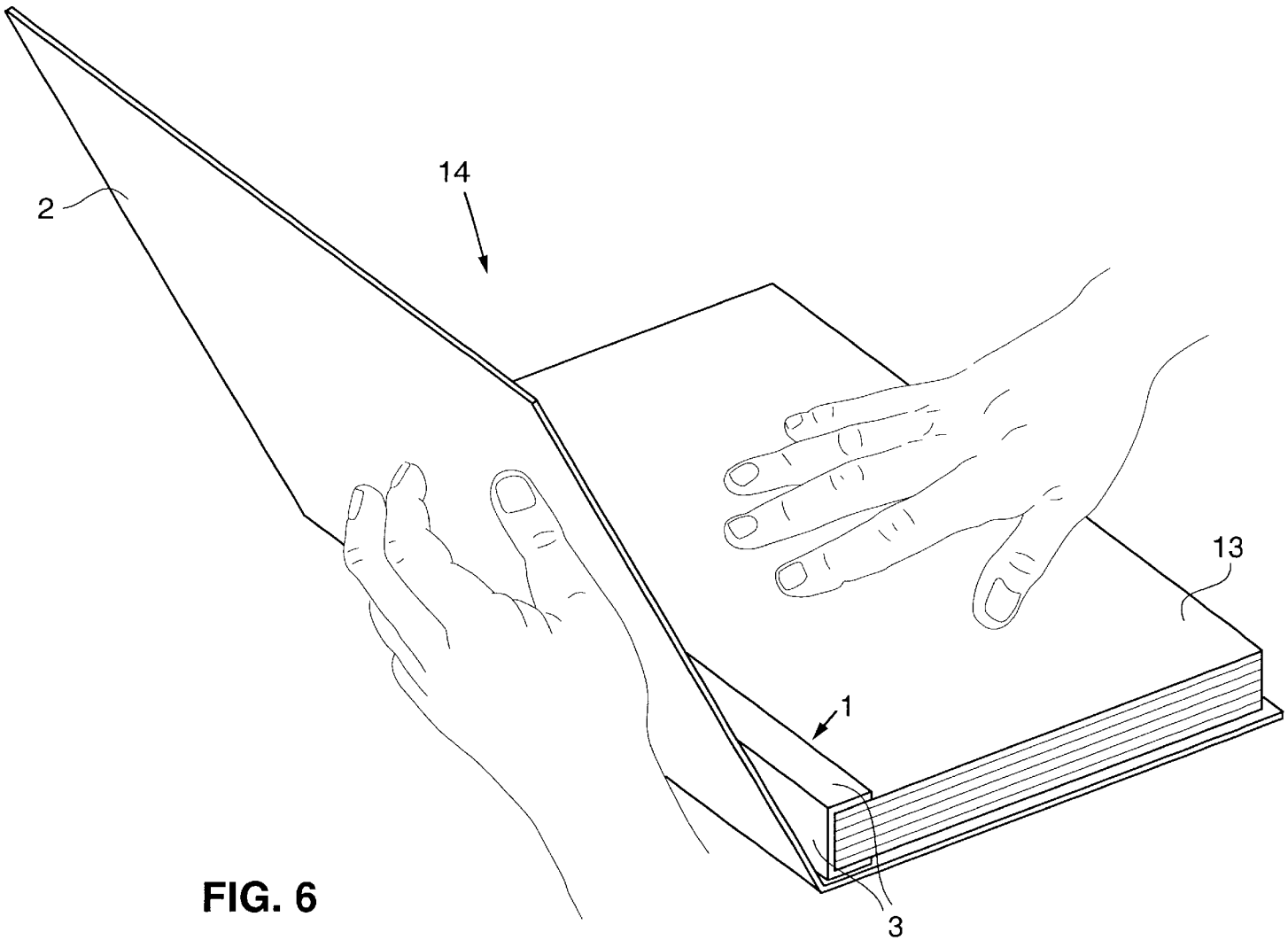
FIG. 6 shows the wrap around book cover being folded over the book and adhered to the pressure activated adhesive of the first embodiment of the bookbinding structure.

As shown in FIG. 6, once the stack 13 has been properly positioned on the cover assembly 2, the assembly is manually folded around the edge of the bound stack. Pressure is applied to the outer surface of the cover assembly 2 in the spine region to ensure that the cover assembly is secured in all areas where the pressure sensitive adhesive is present. This results in a bound book 14 having a cover assembly 2 forming the front and rear book cover together with the book spine.

Figure 7:
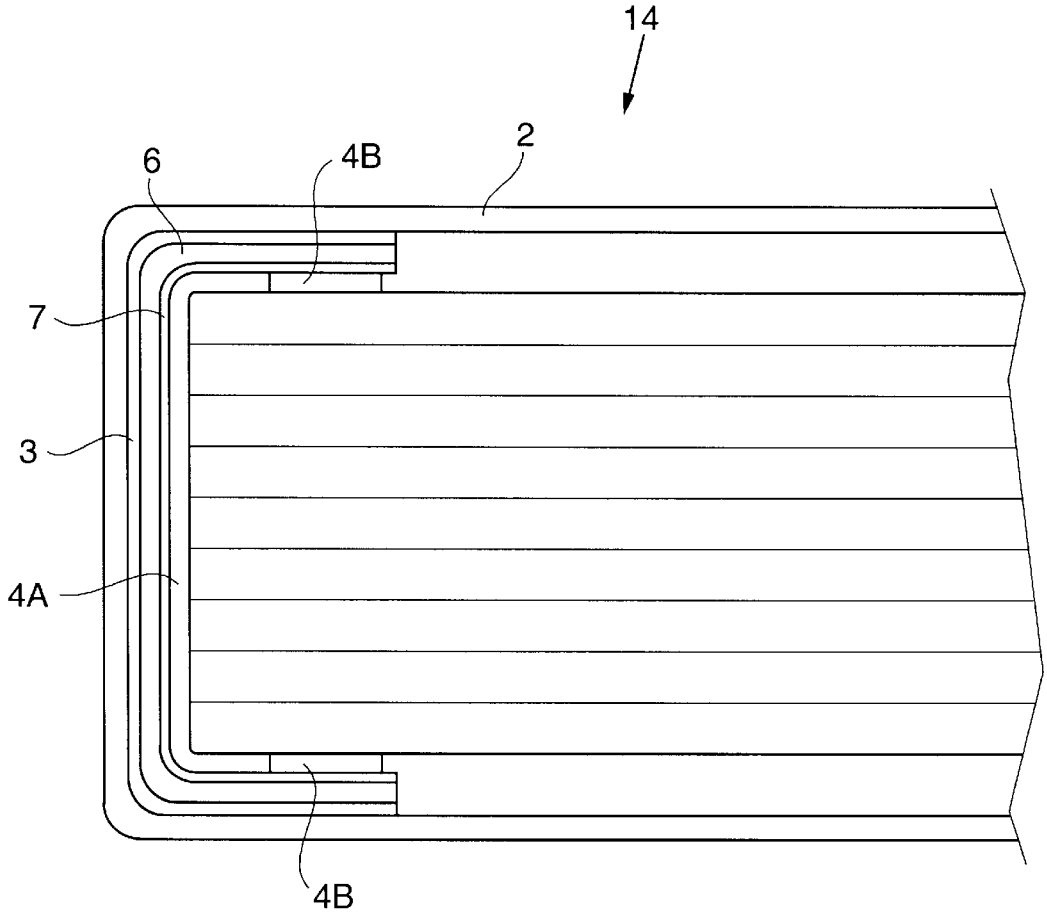
FIG. 7 is an end view of the covered book bound with the bookbinding structure of the first embodiment.

FIG. 7 is a cross-sectional end view of the bound book using the first embodiment bookbinding structure 1 which is not shown to scale so that all of the various layers can be seen. Preferably, the cover assembly 2 is pre-scored at the two locations so that the cover assembly can easily be folded at the proper locations. The cover assembly 2 can be previously printed using any type of process, including printing processes that utilize heat sensitive inks since the cover assembly is never subjected to elevated temperatures when using the first embodiment bookbinding structure 1.

Figure 9A:
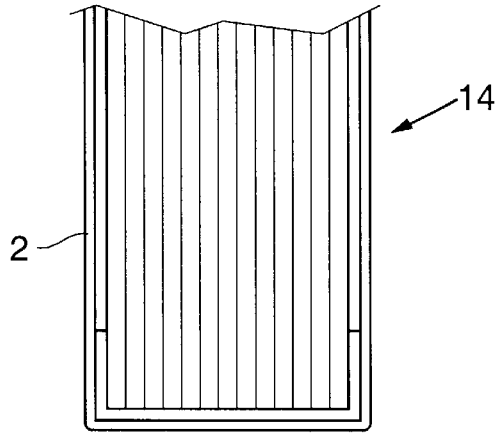
FIG. 9A is an end view of a bound book having a wrap-around book cover which extends over the front, back and spine of the book.
Figure 9B:
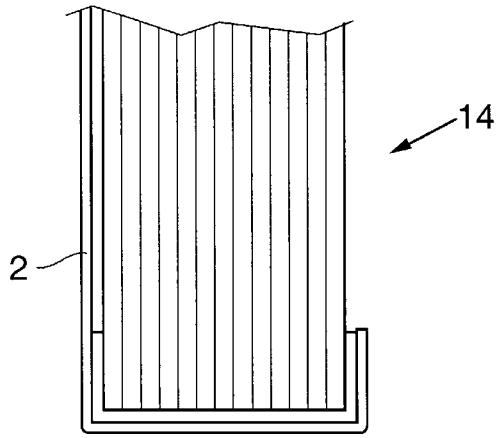
FIG. 9B is an end view of a bound book having a wrap-around book cover which extends over the spine, the front and a small portion of the rear of the book.
Figure 9C:
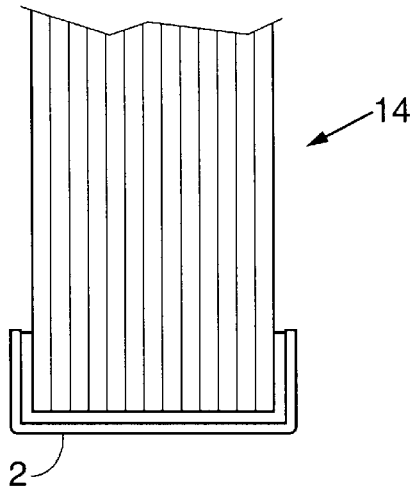
FIG. 9C is an end view of a bound book having a cover which extends over the spine and a small portion of the front and rear of the book.

Note that the cover assembly 2 need only cover that portion of the spine which includes the pressure sensitive adhesive 3. FIG. 9A shows a cross-section of a bound book where the cover assembly covers that front and rear pages of the book together with the spine, as previously described in connection with FIG. 7. FIG. 9B shows a bound book where the cover assembly 2 covers only the front page, a very small portion of the back page and the spine. Finally, FIG. 9C shows a bound book where the cover assembly 2 only covers the spine and a small portion of the front and back pages sufficient to cover the pressure sensitive adhesive.

The manner in which the first embodiment bookbinding structure 1 is applied to the stack 13 so as to bind the stack will now be described. One significant advantage of the present invention is that an existing, commercially available binding machine can be used to carry out the binding sequence. One such machine is described in U.S. Pat. No. 5,052,873, the contents of which are hereby fully incorporated herein by reference. The binding sequence set forth in U.S. Pat. No. 5,052,873 uses a conventional binder strip of the type disclosed in previously noted U.S. Pat. No. 4,496,617.

Figure 2:
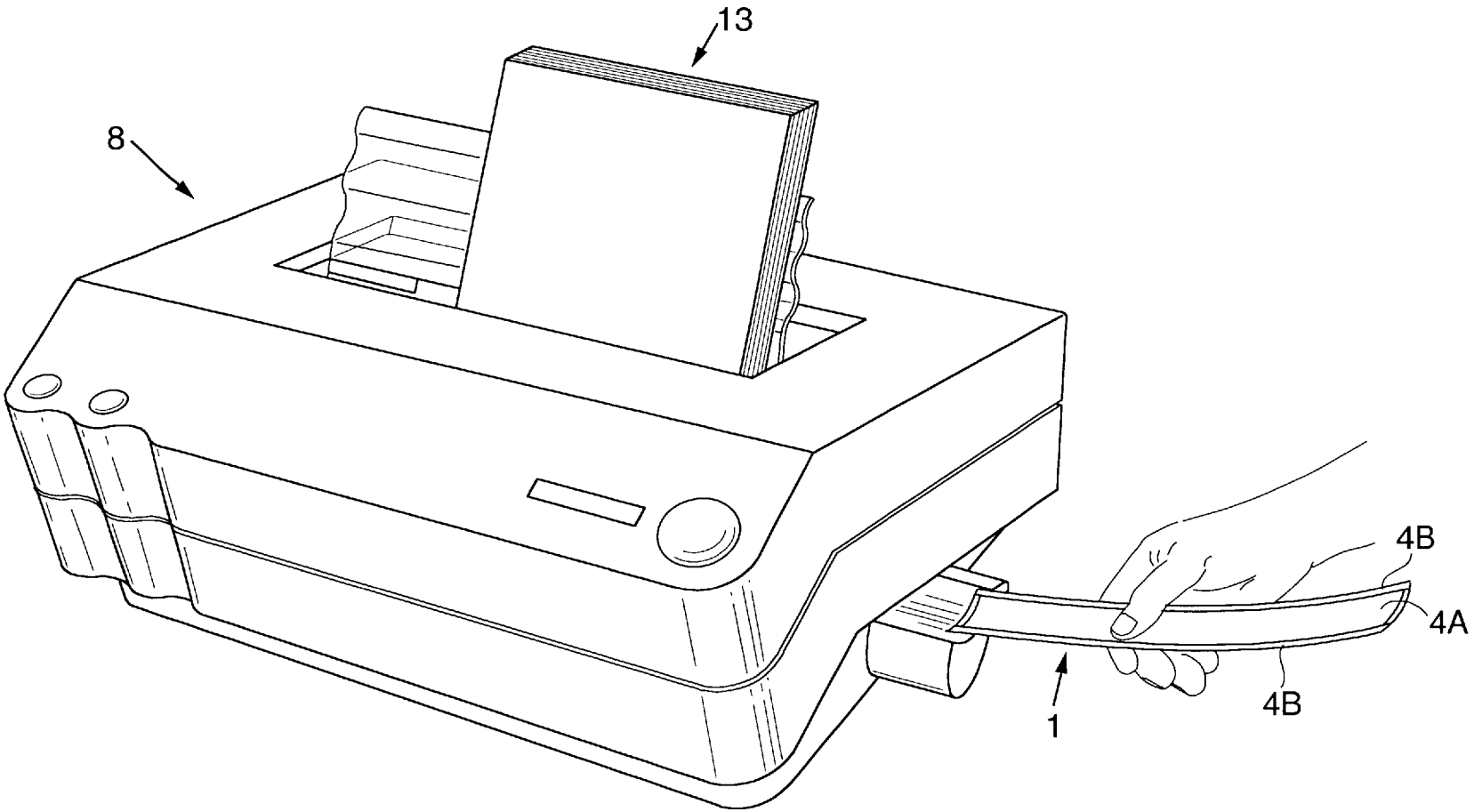
FIG. 2 shows the bookbinding structure being inserted into a conventional binding machine to bind the pages.

FIG. 2 depicts a conventional binding machine 8 such as described in U.S. Pat. No. 5,052,873. Machine 8 has a stack 13 to be bound inserted into the machine input. The thickness of the stack is automatically measured and the appropriate width binding structure 1 is displayed. As is the case with conventional binder strips, the binding structure 1 is preferably available in three widths to accommodate stacks 13 of varying width. Such widths include "Narrow", "Medium" and "Wide", with the width of the central adhesive band 4A being altered for each binder structure 1 width. Machine 8 will specify a structure 1 width having a central adhesive 4A width that is at least as wide as the measured thickness of the stack 13. A binding structure 1 of the appropriate width is then manually fed into the strip feed input of the machine 8. The machine then automatically carries out the binding sequence by appropriately positioning the structure 1 relative to the edge of the stack 13 and applying a combination of heat and pressure as will be described.

Figure 3A:
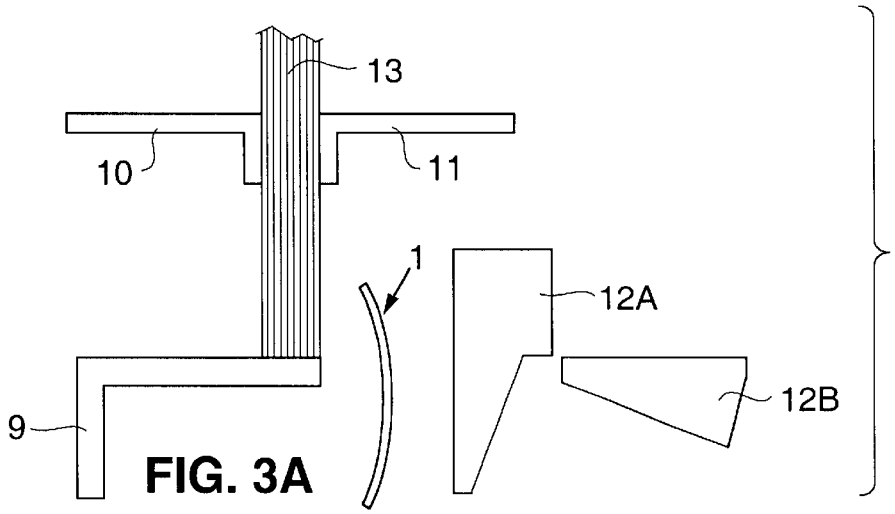
FIGS. 3A–3E show the sequence of binding a stack using the subject bookbinding apparatus and the binding machine of FIG. 2.

The binding sequence is depicted schematically in FIGS. 3A through 3F. End views are shown of the stack 13 and the binding structure 1. Referring to FIG. 3A, the stack 13 to be bound, after loading, is gripped between a pair of clamps 10 and 11 and is initially supported on a cool platen 9. A strip positioning apparatus (not depicted) positions the binding structure 1 previously fed into the machine so that the adhesive matrix 4 is facing the stack 13. The vertical position of the structure 1 relative to the stack 13 is automatically set in accordance with the thickness of the stack as previously measured. A thin stack 13 will result in the structure 1 being positioned relatively high so that the edges of the structure 1 will extend equally over the front and rear pages of the bound stack. Similarly, a thick stack will result in the structure 1 being positioned somewhat lower. A heated platen having a rotating segment 12A and a non-rotating segment 12B is positioned facing the binding structure 1. The platen segments 12A and 12B are at least as long as the length of the stack and the length of the elongated binding structure 1.

Figure 3B:
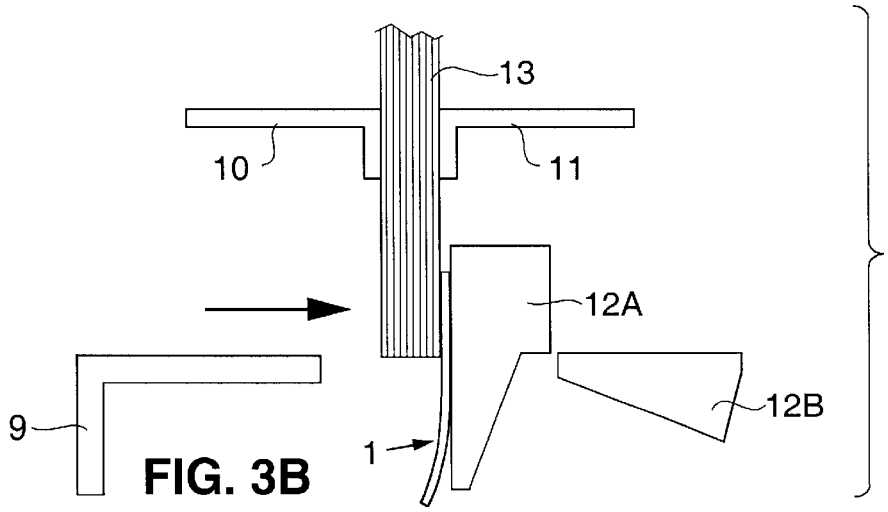
Figure 3C:
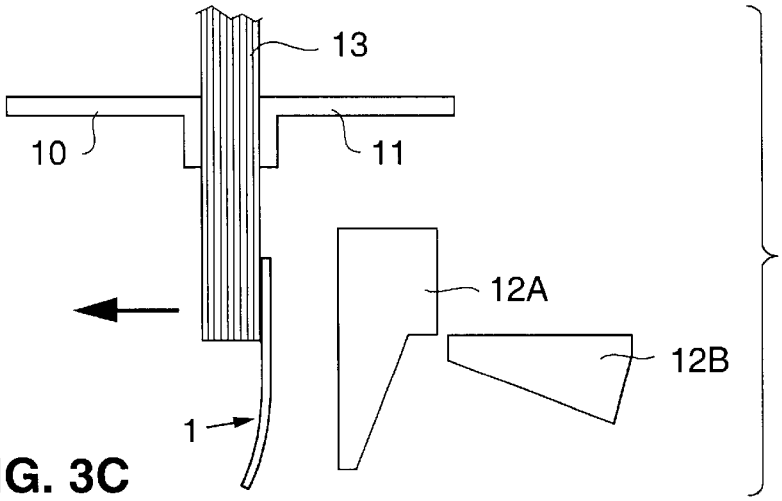

As shown in FIG. 3B, the stack 13 is moved laterally away from the cold platen 9 towards the rotating platen segment 12A. This movement is carried out by way of clamps 10 and 11 which support and move the stack. The lower portion of the stack 13 is forced against the heated rotating platen portion 12A, with one edge of the binding structure 1 being disposed between the platen portion 12A and the stack 13. Note that the binding machine element which supports the opposite side of stack 13 at this point in the sequence is not depicted in the drawings. The resultant heat and pressure applied to one edge of the bookbinding structure 1 results in activation of one of the outer adhesive bands 14B (FIG. 1A). This will cause an adhesive bond or seal to be formed between the structure 1 and the front page of stack 13. Since the outer adhesive bands 14B are high tack when activated, the binding structure 1 remains bonded to the front page of the stack 13 when the stack is moved away from the heated rotating platen portion 12A as shown in FIG. 3C.

Figure 3D:
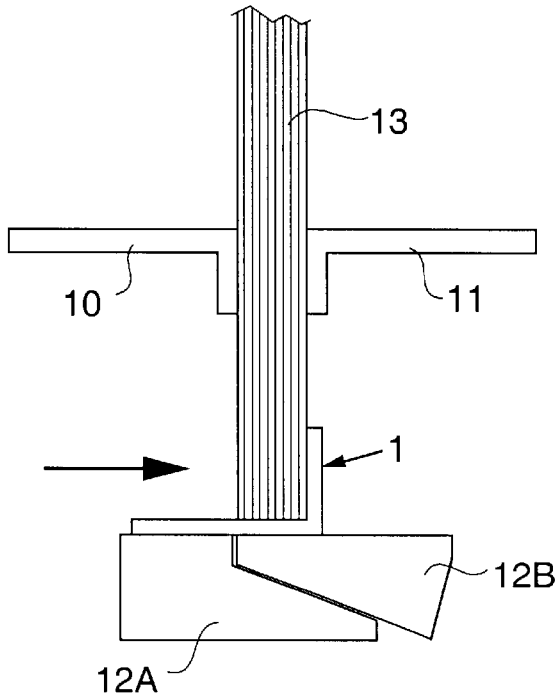
Figure 3E:
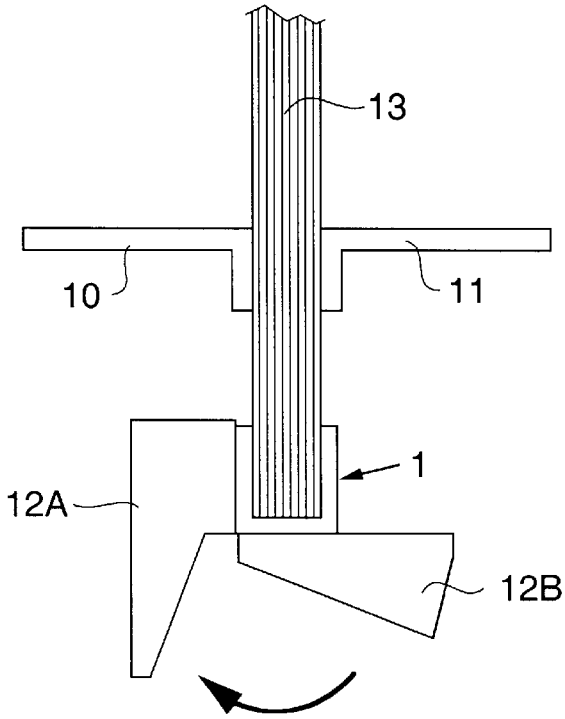

As shown in FIG. 3D, the rotating platen segment 12A is rotated 90 degrees so that both the rotating and fixed platen segments 12A and 12B define a flat upper surface. This permits stack 13 to be moved to the right over the platen segments. This causes the bookbinding structure 1 to be folded around the lower edge of the stack 13. The binding machine 8 pauses briefly in this position so that the central adhesive band 4A will have time to become molten and to flow upward by way of capillary action between the individual pages of the stack 13 thereby fulling wetting the pages with the adhesive. The rotating platen segment 12A is then rotated 90 degrees back to the original position as shown in FIG. 3E. This results in the remaining edge of the bookbinding structure 1 to be folded around the edge of the stack 13, with the remaining outer adhesive band 4B being positioned facing the rear page of the stack 13. The stack 13 is then forced against the rotating platen portion 12A thereby activating the outer adhesive band 4B so as to form the final adhesive bond. The bound stack 13 is then removed from the binding machine and permitted to cool for a few minutes so that the adhesives have an opportunity to set. The cover assembly 2 is then secured to the stack as previously described in connection with FIGS. 4, 5 and 6. Note that the first embodiment bookbinding structure 1 could also be implemented without substrate 6. In that event, undercoat adhesive layer 7 is disposed directly on the pressure activated adhesive layer 3. The release liner 5 then provides the additional function of acting as a substrate and supporting the structure 1 during the binding sequence previously described in connection with FIGS. 3A through 3E.

Figure 1B:
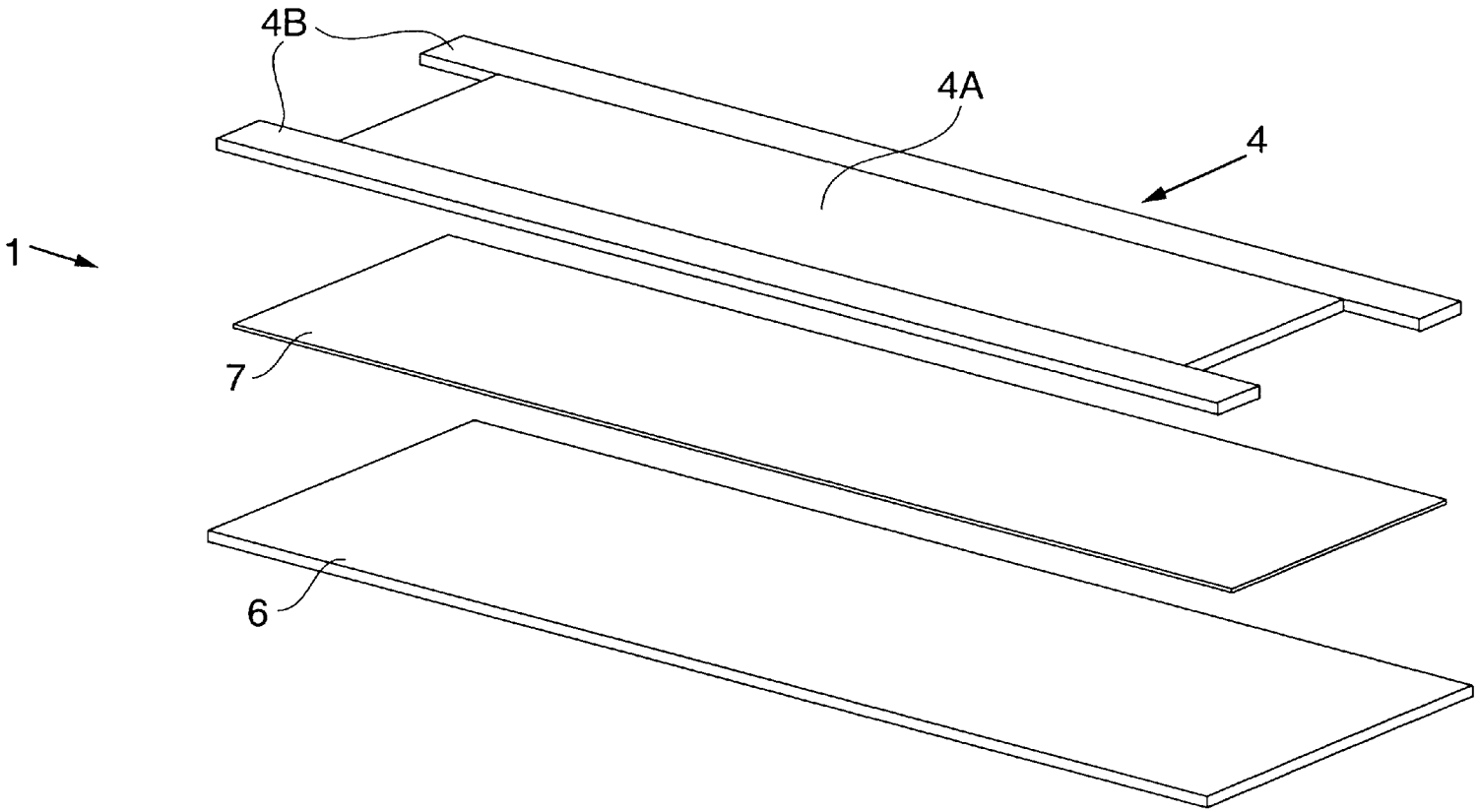
FIG. 1B is an exploded view of a second embodiment of the subject bookbinding structure.

A second embodiment of the present invention is depicted in FIG. 1B. The second embodiment bookbinding structure 1 includes an adhesive matrix 4 similar to that of the first embodiment structure of FIG. 1A. A substrate 6 is provided having the same shape as that of the first embodiment, with there being an undercoat adhesive layer 7 similar to layer 7 of FIG. 1A. The second embodiment structure 1 does not include, among other things, the pressure activated adhesive 3 of the first embodiment.

A stack 13 is bound using the second embodiment structure 1 in the same manner as that of the first embodiment structure. Once the steps of FIGS. 3A through 3E are carried out using the conventional binding machine 8, the bound stack is permitted to cool. The substrate 6 is then manually removed from the stack in much the same manner as the release liner 5 is removed from the stack as depicted in FIG. 4. Thus, the substrate 6 of the second embodiment also functions as a release liner.

Removal of substrate 6 exposes the undercoat adhesive layer 7. Adhesive layer 7 together with the remaining adhesive of the adhesive matrix 4 is then used to attach a cover assembly 2 to the bound stack 13. Since the adhesives are heat activated, it is necessary to reheat the adhesives so that they can be used for this purpose. It is possible to again use a conventional binding machine 8 to carry out the sequence for attaching the cover assembly 2 to the bound stack 13, as will be described.

The cover assembly 2 of appropriate dimensions is first placed on a flat surface and the bound stack 13 is positioned over the assembly in much the same manner as previously described in connection with the first embodiment. The cover assembly 2 is folded around the stack 13 to the desired final position. Preferably, the assembly is pre-scored to facilitate this step. Since the adhesives are not activated at this point, proper positioning is somewhat easier to accomplish as compared to the first embodiment. The cover assembly/stack combination 2,13 is then inserted into the conventional binding machine 8, taking care to hold the cover assembly 2 in place until the combination is gripped by the machine clamps 10 and 11 (FIG. 3A). The binding machine 8 must be slightly modified to carry out the cover assembly 2 attachment sequence since the machine normally requires activation when a binder strip is manually fed into the machine as shown in FIG. 2. Such modification would simply simulate the detection of a binder strip being fed into the machine. Alternatively, it is possible to activate the machine 8 by momentarily inserting a binder strip into the machine so as to initiate the sequence and to then rapidly withdraw the strip from the machine since the strip is not needed and should not be present.

Figure 8A:
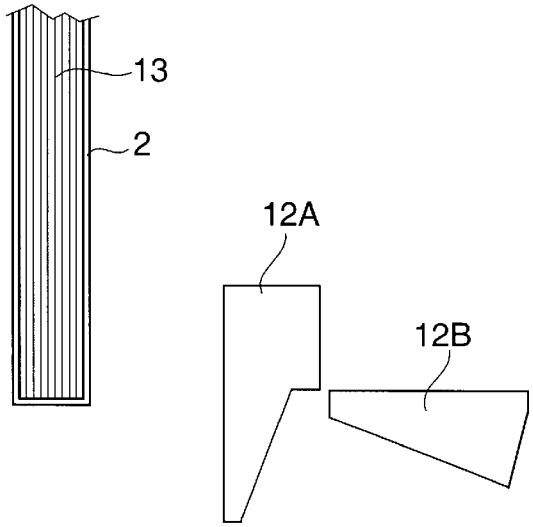
FIGS. 8A through 8E show the sequence for attaching the cover to the bound stack using the second embodiment bookbinding structure where the FIG. 2 binding machine is used to activate the adhesive used to attach the cover.
Figure 8B:
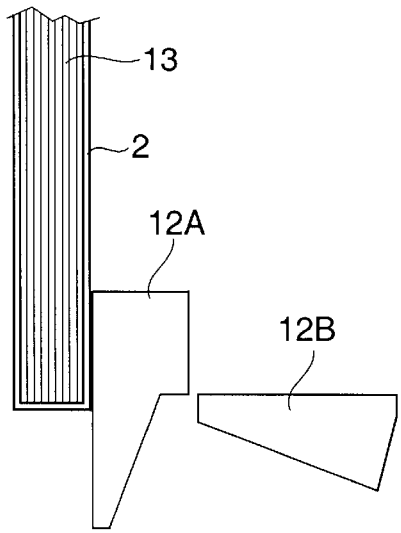

FIG. 8A shows a book 14, which includes the bound stack 13 and the folded cover assembly 2, installed in the binding machine 8 and resting on the cool platen 9 (not depicted). Book 14 is secured by opposing clamps 10 and 11 (not depicted). This point in the binding machine sequence corresponds to that shown in FIG. 3A where the binding structure 1 is being applied to the stack 13. Note that FIG. 8A does not include a binding structure as does FIG. 3A since the structure was previously applied. The stack 13 is then forced against heated platen segment 12A so that one of the outer adhesive bands 4B is activated and compressed between the cover assembly 2 and the front page of the stack 13 as shown in FIG. 8B. This corresponds to FIG. 3B of the binding machine 8 sequence. Thus, a first adhesive seal in created between the stack 13 and the cover assembly 2.

Figure 8C:
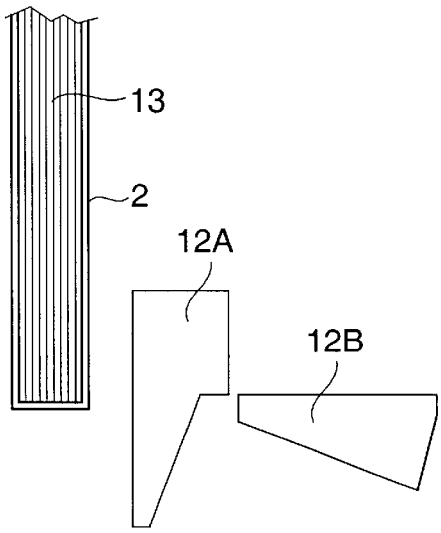
Figure 8D:
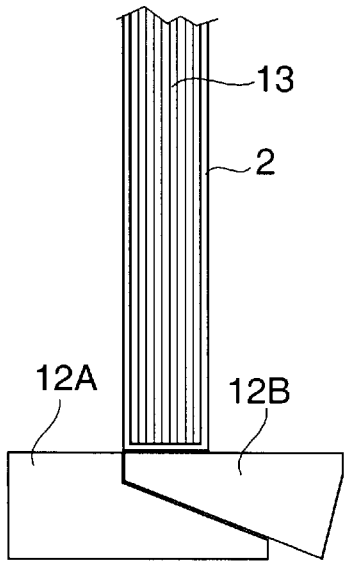

The stack 13 with cover 2 is then moved away from the heated platen segments 12A and 12B as indicated in FIG. 8C and the rotating platen segment is rotated 90 degrees as shown in FIG. 8D. The stack 13 is then positioned over the heated platen sections 12A and 12B so that a seal will be formed between the edge of the stack 13 and that part of the cover 2 which forms the spine. FIGS. 8C and 8D correspond generally to FIGS. 3C and 3D, respectively.

Figure 8E:
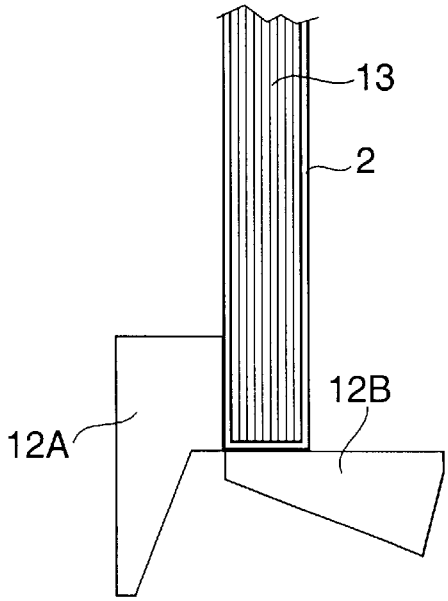

The rotating platen segment 12A is then rotated back 90 degrees, with the stack 13 and platen segment 12A then being forced together as shown in FIG. 8E which corresponds to FIG. 3E. The resultant application of heat and pressure will cause a further adhesive seal to be formed between the cover 2 and the last page of the stack 13. This will complete the binding sequence so that the bound book can be removed from the binding machine and permitted to cool.

Since the cover assembly 2 is heated when the second embodiment bookbinding structure 1 is used, any printing on the cover assembly should be carried out using inks not sensitive to heat. Further, substrate 6 must be made of a material that will support the various molten adhesives applied to the substrate when the bookbinding structure is fabricated and will provide sufficient support during the binding sequence of FIGS. 3A through 3E so that the structure 1 can be manipulated and heated by the binding machine 8 in order to carry out the sequence. Still further, the substrate 6 must be made of a material that has a sufficiently high release value to permit the substrate to be manually separated from the bound book 13. It has been found that the substrate material of the second embodiment should not contain free silicon since this material has been found to contaminate the adhesives and destroy the adhesive properties. Thus, the material must be either fully reacted silicon based or be non-silicon based. The substrate could be fabricated from a liner material having a repositionable adhesive such as a product sold under the designation ReMount 6091 by the Industrial Tape and Specialties Division of 3M located in St Paul, Minn.

Figure 1C:
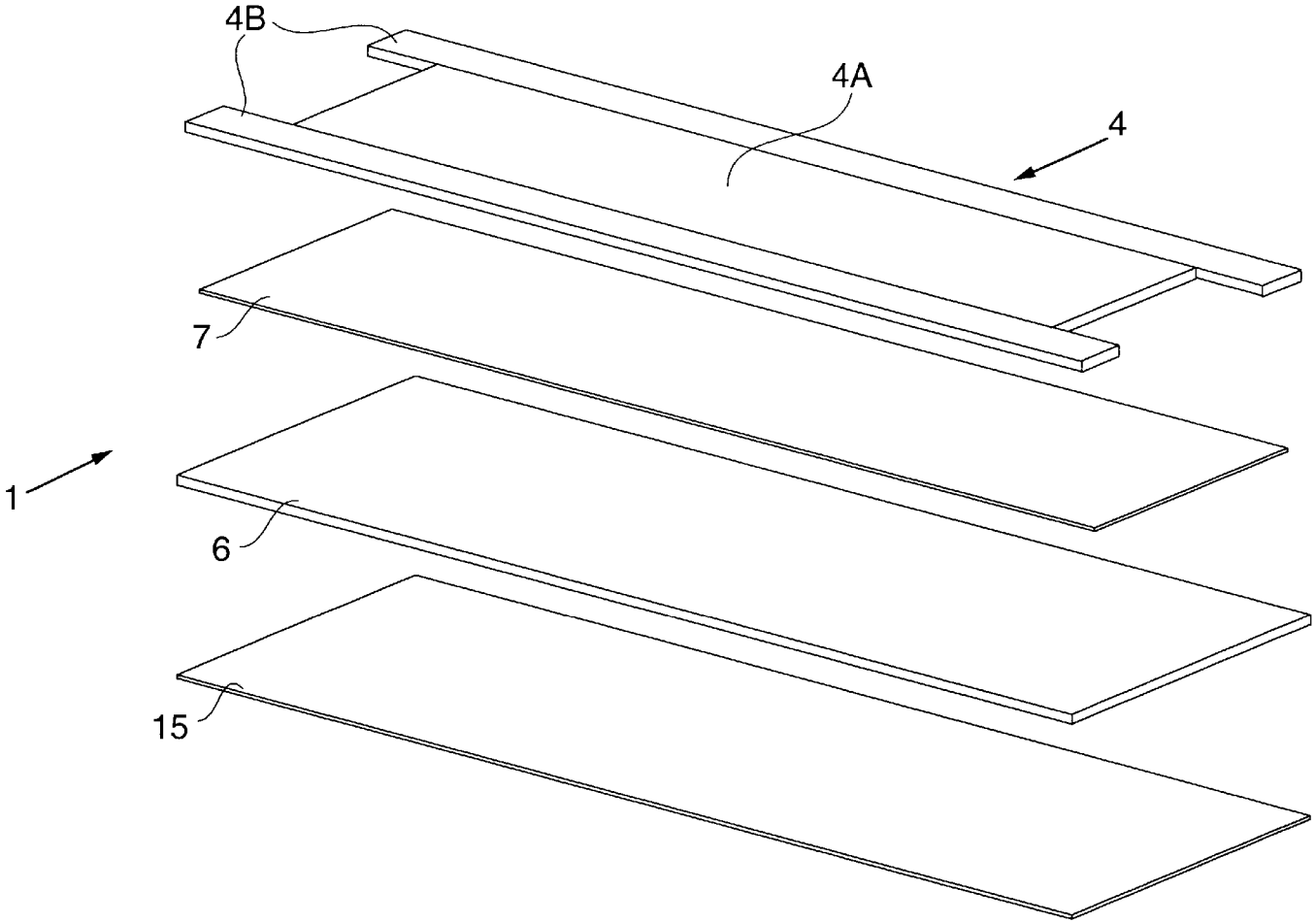
FIG. 1C is an exploded view of a third embodiment of the subject bookbinding structure.

FIG. 1C is an exploded view of a third embodiment bookbinding structure. The third embodiment is similar to the first embodiment (FIG. 1A) except that a solvent activated adhesive 15 is used instead of a pressure activated adhesive 3. This feature eliminates the requirement for a release liner, such as liner 5 of the first embodiment. The solvent activated adhesive 15 must be able to withstand temperatures up to about 425° F. which are created during the binding sequence as depicted in FIGS. 3A through 3E. One suitable solvent activated adhesive is an adhesive sold under the designation Weldbond by Frank T. Ross and Sons, Inc. in Spring Grove, Ill. The Weldbond adhesive may be activated by either water or alcohol.

The manner in which the stack 13 is bound using the third embodiment bookbinding structure 1 is the same as the first embodiment except that the exposed adhesive 15 must be activated by application of water or alcohol prior to placement of the bound stack 13 on the cover assembly 2. Since the cover assembly 2 is never subjected to elevated temperatures, it is possible to print the cover assembly 2 using printing techniques that require heat sensitive inks.

Thus a novel bookbinding structure and method have been disclosed. Although three embodiments of the present invention have been described in some detail, it is to be understood that various changes may be made by those skilled in the art without departing from the spirit and scope of the invention as defined by the appended claims.

What is claimed is:

1. A method of binding a stack of sheets into a book comprising:

providing a bookbinding structure which includes an elongated substrate and a heat activated adhesive matrix supported on the substrate, with the adhesive matrix having a length which corresponds to a length of the stack of sheets and a width greater than a thickness of the stack of sheets and a layer of pressure activated adhesive supported on the substrate intermediate the heat activated adhesive matrix and the substrate;

positioning the bookbinding structure adjacent an edge of the stack of sheets;

applying heat and pressure to the bookbinding structure so as to bind the edge of the stack of sheets by way of the heat activated adhesive matrix;

removing the heat and pressure; and subsequent to the removing the heat and pressure, securing a cover assembly to the stack of sheets by way of the pressure activated adhesive layer by separating the substrate from the pressure activated adhesive layer so as expose the pressure activated adhesive layer, with the cover assembly being dimensioned so as to cover at least the adhesive matrix.

2. The method of claim 1 further including, prior to the securing, printing on cover assembly.

3. The method of claim 2 wherein the printing is carried out using a heat sensitive ink.

4. A method of binding a stack of stack of sheets having front and back covers and an edge, said method comprising:

positioning a bookbinding structure which includes a matrix of heat activated adhesive and a solvent activated adhesive layer adjacent the edge of the stack;

applying heat to the matrix so as to transfer at least some of the heat activated adhesive to the edge of the stack;

removing the heat from the matrix; and subsequent to the removing heat from the matrix, securing a cover assembly to the stack, so that at least the adhesive matrix is covered by the cover assembly, by applying a solvent to the solvent activated adhesive layer, with the cover assembly being secured by the solvent activated adhesive layer.

5. The method of claim 4 further including, prior to the securing, printing on the cover assembly.

6. The method of claim 5 wherein the printing is carried out using a heat sensitive ink.

7. A method of binding a stack of sheets into a book comprising:

providing a bookbinding structure which includes an elongated substrate and a heat activated adhesive matrix supported on the substrate, with the adhesive matrix having a length which corresponds to a length of the stack of sheets and a width greater than a thickness of the stack of sheets and a heat activated adhesive layer disposed intermediate the adhesive matrix and the substrate;

positioning the bookbinding structure adjacent an edge of the stack of sheets;

applying heat and pressure to the bookbinding structure so as to bind the edge of the stack of sheets by way of the adhesive matrix;

removing the heat and pressure; and exposing the heat activated adhesive layer by removing the substrate; and subsequent to the removing the heat and pressure, securing a cover assembly to the stack by way of the heat activated adhesive layer by removing the substrate so as to expose the heat activated adhesive layer and then applying heat to the heat activated adhesive layer, with the cover assembly being dimensioned to cover at least the adhesive matrix.

* * * * *

UNITED STATES PATENT AND TRADEMARK OFFICE

CERTIFICATE OF CORRECTION

PATENT NO. : 6,685,415 B2
DATED : February 3, 2004
INVENTOR(S) : Christopher J. Rush et al.

It is certified that error appears in the above-identified patent and that said Letters Patent is hereby corrected as shown below:

Column 9,
Line 19, "a stack of stack of sheets" should be -- a stack of sheets --.

Signed and Sealed this

Ninth Day of March, 2004

JON W. DUDAS
*Acting Director of the United States Patent and Trademark Office*